US005548842A

United States Patent [19]

Wiseman, Sr.

[11] Patent Number: 5,548,842

[45] Date of Patent: Aug. 27, 1996

[54] PROTECTIVE GARMENT WITH HARNESS ACCESS

[75] Inventor: Timothy R. Wiseman, Sr., Richmond, Va.

[73] Assignee: E. I. Du Pont de Nemours and Company, Wilmington, Del.

[21] Appl. No.: 223,565

[22] Filed: Apr. 6, 1994

[51] Int. Cl.[6] ..... A41D 13/00

[52] U.S. Cl. ..... 2/69; 128/201.29; 2/2

[58] Field of Search ..... 2/69, 79, 80, 81, 2/2.11–2.17, 901, 2, 227; 128/201.29, 202.11, 202.12, 202.19, 846, 869, 873, 874, 875; 54/79.1, 79.2; 297/464, 465, 468

[56] References Cited

U.S. PATENT DOCUMENTS

| | | | |
|---|---|---|---|
| 2,979,153 | 4/1961 | Hoagland et al. . | |
| 3,058,187 | 10/1962 | Gugen | 2/2.17 |
| 3,973,643 | 8/1976 | Hutchinson . | |
| 4,177,877 | 12/1979 | Gallinati . | |
| 4,230,114 | 10/1980 | Feather | 2/227 |
| 4,273,216 | 6/1981 | Weissmann . | |
| 4,682,671 | 7/1987 | Hengstenberger et al. . | |
| 4,854,418 | 8/1989 | Hengstenberger et al. . | |
| 5,014,357 | 5/1991 | Wiseman . | |
| 5,048,124 | 9/1991 | Lewis, Jr. et al. . | |
| 5,050,241 | 9/1991 | Flowers et al. . | |
| 5,073,988 | 12/1991 | Lewis et al. . | |
| 5,170,506 | 12/1992 | Lewis, Jr. et al. . | |
| 5,208,919 | 5/1993 | Fields . | |
| 5,210,879 | 5/1993 | Miller | 2/69 |

FOREIGN PATENT DOCUMENTS

| | | |
|---|---|---|
| 1420783 | 4/1973 | United Kingdom . |

*Primary Examiner*—C. D. Crowder
*Assistant Examiner*—Gloria Hale

[57] ABSTRACT

A protective garment with a support harness conduit for safety harness access while maintaining reduced fluid flow between the inside and the outside of the garment.

3 Claims, 1 Drawing Sheet

FIGURE
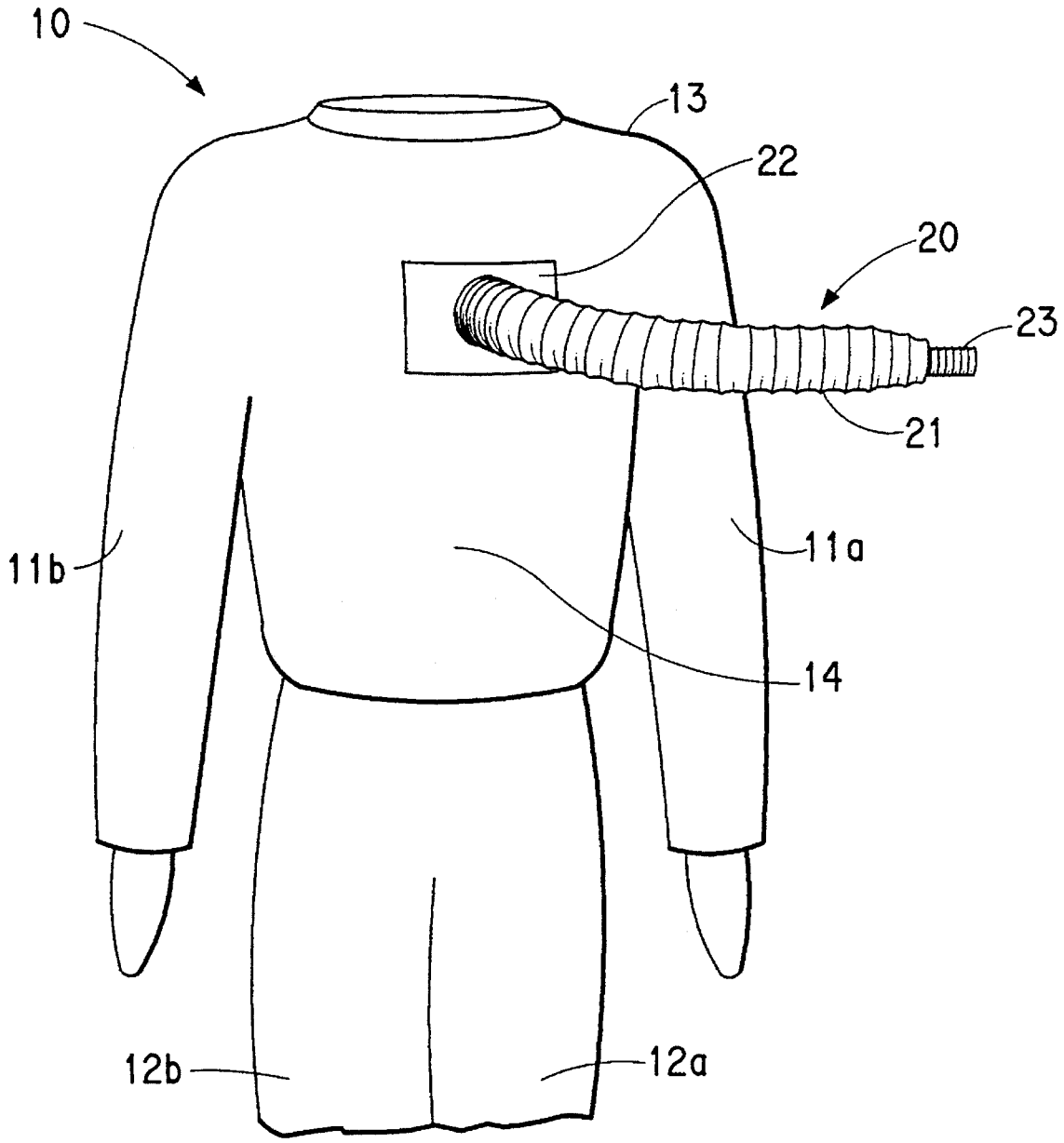

PROTECTIVE GARMENT WITH HARNESS ACCESS

BACKGROUND OF THE INVENTION

1. Field of the invention

The present invention relates to a protective garment which is fitted with safety harness access while maintaining a degree of sealing between the inside and the outside of the suit.

Garments are known for protecting the wearer from hazards including flame, hot and/or corrosive chemicals, molten metals, and the like. These garments are generally somewhat bulky and represent some impairment of maneuverability. The wearer is generally rendered more awkward in his movements due to the garment and there is a recognized need for protection against falls, whether worn in a hazardous situation or not. Wearing a safety harness over the top of a protective garment causes even further restriction of movement and can adversely affect other protective systems associated with the garment.

2. Description of the Prior Art

U.S. Pat. Nos. 4,682,671 and 4,854,418, issued Jul. 28, 1987 and Aug. 8, 1989, respectively, relate to a safety harness and jacket combination, but the jacket is present in that combination only as a means to carry the safety harness and render more convenient the use of the safety harness. There is no suggestion of any protective garment or sealing the inside of the garment from the outside of the garment.

U.S. Pat. No. 5,208,919, issued May 11, 1993, discloses a firefighter's coat with a cuff construction for excluding heat and water from the inside of the coat during use in a firefighting environment.

SUMMARY OF THE INVENTION

In accordance with the present invention, there is provided a protective garment having two arm sections, a neck section, and a torso section with a support harness conduit in the torso section. The protective garment is fitted with an opening in the torso section and the first end of a flexible harness conduit having two ends is attached to the torso section at the opening. The second end of the harness conduit is a sphincter means to close the conduit and reduce or prevent interchange of fluids between the inside and the outside of the garment. A wearer of the protective garment can also wear a support harness underneath the suit with a support line for the harness;—the support line extending from the harness through the opening in the garment, through the harness conduit, and out the sphincter means.

BRIEF DESCRIPTION OF THE DRAWINGS

The FIGURE represents a somewhat diagrammatical perspective view of a preferred embodiment of the present invention.

DETAILED DESCRIPTION

Protective garments of the present invention include those with any of a variety of laminated constructions for protection against hazards, including steam, flame, hot and/or corrosive chemicals, and the like, which constructions include a durable, usually liquid impervious outer shell and an adjacent thermal insulative inner liner which may include other barrier layers. Such protective garments can take the form of a jacket or a full body suit with or without a head covering or any other commonly-used protective apparel. A suitable shell for protection against hazards, such as high temperatures or steam, is a woven aramid fabric, such as a fabric woven from poly(p-phenylene terephthalamide) which has been laminated to a liquid impervious layer, such as an aluminum foil—poly(ethylene terephthalate) film laminate. A suitable liner can be, for example, a single layer of woven poly(m-phenylene isophthalamide) or a multilayer laminate, including at least a layer of woven poly(m-phenylene isophthalamide) and a nonwoven layer, such as one or more layers of spun-laced fabrics of poly(p-phenylene terephthalamide). A protective garment of this general construction is disclosed in U.S. Pat. No. 5,014,357, and other suitable protective garment construction are disclosed in U.S. Pat. Nos. 5,050,241 and 5,170,506.

Referring to the FIGURE, protective garment 10 includes two arm sections 11*a* and 11*b*, two leg sections 12*a* and 12*b*, a neck section 13, and torso section 14. Flexible harness conduit assembly 20 is attached to torso section 14 of the protective garment. Flexible harness conduit assembly 20 includes flexible harness conduit 21 attached at one end to a hole (not shown) through torso section 14 by means of attachment patch 22. Flexible harness conduit 21 includes sphincter means 23 at the second end. Sphincter means such as hook and loop fabric, 23 can be sealed around a support line extending from a support harness worn underneath the protective garment, through the harness conduit, and out the sphincter means.

Flexible harness conduits of this invention can be in extensible form, such as in accordion or pleated form; or they can be in a cloth or tubing form so long as the conduit is flexible and in a form which provides a degree of protection comparable with that of the rest of the garment. As an example, the flexible harness conduit can be made from the same material as is used in the outer shell of the protective garment. The hole through torso section 14 should be of a size to readily pass an end of the support harness or a line to the support harness. Generally, a ring from the support harness passes through the hole in torso section 14 into flexible harness conduit assembly 20 and a support line passes through sphincter means 23 in the harness assembly 20 to be attached to the ring from the support harness.

Sphincter means which are acceptable for use in this invention include elastomer-based rings, hook and loop fabrics (known as "VELCRO" fasteners), cord bindings, adhesive tape, and the like. Preferably, the sphincter means will be of a sort which does not permanently adhere to any support line used therewith.

While a preferred embodiment has been shown and described in the foregoing detailed description, it will be understood that the invention is capable of numerous modifications, rearrangements, and substitution of parts without departing from the spirit of the invention as set forth in the appended claims.

I claim:

1. In a protective garment having an inside and an outside, two arm sections, a neck section, and a torso section, a support harness conduit comprising:

(a) an opening in the torso section between the arm sections and below the neck section;

(b) a flexible harness conduit having two ends with the first end attached to the torso section at the opening;

(c) a sphincter means at the second end of the harness conduit to close the conduit and reduce interchange of fluids between the inside and the outside of the garment, whereby a wearer of the protective garment can also wear a support harness underneath the garment with a support line for the harness; the support line extending from the harness through the opening in the torso section of the garment, through the harness conduit, and out the sphincter means.

2. The protective garment of claim 1 wherein the flexible harness conduit is extensible.

3. The protective garment of claim 1 wherein the sphincter means is made from hook and loop fabric.

* * * * *